United States Patent [19]

Minard

[11] Patent Number: 4,666,531

[45] Date of Patent: May 19, 1987

[54] DEVICE AND METHOD FOR CLEANING FIN-TYPE HEAT EXCHANGERS IN AIR DUCTS

[76] Inventor: Gary A. Minard, 9900 Rolling Meadow Blvd, Mustang, Okla. 73064

[21] Appl. No.: 683,253

[22] Filed: Dec. 18, 1984

[51] Int. Cl.[4] ..... B08B 9/06

[52] U.S. Cl. ..... 134/26; 15/104.04; 15/3.5; 15/3.51; 15/104.06 R; 165/95; 162/290

[58] Field of Search ..... 134/24, 23, 26; 165/95, 165/DIG. 13; 15/104.04, 104.06 R, 3.5, 3.51; 162/290

[56] References Cited

U.S. PATENT DOCUMENTS

| | | | |
|---|---|---|---|
| 1,939,394 | 7/1933 | Harpster | 257/248 |
| 1,978,555 | 10/1934 | Snow | 257/1 |
| 2,158,792 | 9/1934 | Erbach | 62/212 |
| 2,685,293 | 8/1954 | Dauphinee et al. | 134/53 |
| 2,745,639 | 5/1956 | Dougherty | 257/1 |
| 2,918,925 | 12/1959 | Dopler | 134/108 |
| 3,320,964 | 5/1967 | Tripp | 134/200 |
| 3,407,099 | 10/1968 | Schell | 148/153 |
| 3,828,570 | 8/1974 | Stutz | 62/282 |
| 4,100,887 | 7/1978 | Malmstom et al. | 122/379 |
| 4,332,292 | 6/1982 | Garberick | 165/95 |
| 4,398,355 | 8/1983 | Dove | 162/290 |
| 4,562,885 | 1/1986 | Pausch | 165/95 |

FOREIGN PATENT DOCUMENTS

| | | | |
|---|---|---|---|
| 1132410 | 9/1982 | Canada | 165/95 |
| 2833006 | 2/1980 | Fed. Rep. of Germany | 165/95 |
| 627302 | 10/1978 | U.S.S.R. | 165/95 |

*Primary Examiner*—Andrew H. Metz
*Assistant Examiner*—Sharon T. Cohen
*Attorney, Agent, or Firm*—Laney, Dougherty, Hessin & Beavers

[57] ABSTRACT

A cleaning system is provided for an air conditioner or heater of the type having an air duct for conveying air with a fin-type heat exchanger transversely mounted in the air duct for heat exchange with the air conveyed in the duct. The cleaning system comprises a pair of tubes mounted horizontally across the air duct on opposite sides of and parallel to the heat exchanger adjacent the upper end of the sides of the heat exchanger. The pair of tubes each have a plurality of longitudinal slots therein for fan-shaped spraying of cleaning liquid from each of the slotted holes toward the heat exchanger. A cart with a tank of cleaning liquid can be rolled to a location adjacent the air duct. The cart has a pump for pumping liquid from the tank to the tubes and a hose for quick connection to either of the tubes.

8 Claims, 5 Drawing Figures

DEVICE AND METHOD FOR CLEANING FIN-TYPE HEAT EXCHANGERS IN AIR DUCTS

BACKGROUND OF THE INVENTION

1. Field of the Invention

This invention relates generally to air conditioning and heating systems and more specifically to methods and devices for cleaning heat exchanger fins and coils in the air ducts of such systems.

2. Description of the Prior Art

Many air conditioning and heating systems utilize air duct work for carrying fan-blown air to the desired locations in a building for heating or cooling the interior of the building. In order to heat or cool the air which is blown through the ducts, fin-type heat exchangers are transversely mounted in the air ducts. A heated or cooled heat transfer material such as a refrigerant is pumped through coils in the heat exchanger which heats or cools the fins attached to the coil. Generally, the fins are vertically oriented and the edges of the fins combine to form opposing walls of the heat exchanger. Thus, the air moving in the ducts must pass through the heat exchanger exchanging heat with the fins and coils as it so moves.

Although it is common to transversely mount air filters in the air ducts to prevent dust and other particles from being circulated with the air moving through the ducts, small particles of dust and other materials escape these filters and accumulate on the heat exchangers. Over a period of time, therefore, grease and dust accumulate on the fins and coils of the heat exchanger restricting the air flow through the heat exchanger and inhibiting heat transfer between the fins and the air. This reduces the efficiency of the heat exchange and increases the heating or cooling cost.

Recognizing this problem of accumulation of dust and grease on the fins and coils of heat exchangers, attempts have been made in the past to provide methods and devices for cleaning such heat exchangers. The most common method is to use a hand-pumped spray bottle containing a cleaning liquid. This bottle is hand-carried to the air duct location containing the heat exchanger and access panels in the air duct are removed. Often, access panels are not provided and it is necessary to cut an access panel in order to reach the heat exchanger. A spray wand from the bottle of cleaning liquid is then maneuvered through the access panel and the cleaning liquid is sprayed on the heat exchanger to remove the accumulations of dirt and grease.

U.S. Pat. No. 4,332,292 discloses a device for cleaning coils. In this device flexible hoses are disposed in an array within the air duct and pointed at the heat exchanger. A set of supply lines extends from each of the hoses in the array to a source of cleaning liquid which can automatically operate to supply liquid to the hoses. As liquid passes through the hoses they whip about to spray the liquid on different sections of the heat exchanger.

Neither of the above methods has been found to be satisfactory because either the man-hours involved in cleaning is too high or the expense of the automatic equipment, maintenance of the equipment and installation of the equipment is too high. Further, neither method cleans the heat exchanger as well as is desirable.

SUMMARY OF THE INVENTION

It is accordingly an object of the present invention to provide an improved method and device for cleaning heat exchangers of the type described.

It is also an object of the present invention to provide such methods and devices for cleaning which are simpler and less expensive to manufacture than other devices which have been mounted in the air ducts.

Yet another object of the present invention is to provide a device and method which will provide cleaning of the heat exchanger fins and coils without the necessity of removing access panels or cutting access panels in the air ducts.

In accordance with the objects of the present invention, a cleaning system is provided for an air conditioner or heater of the type having an air duct for conveying air with a fin-type heat exchanger transversely mounted in the air duct for heat exchange with the air conveyed in the duct. The heat exchanger has vertically extending fins, the edges of which form opposing sides of the heat exchanger. The cleaning system comprises a pair of tubes mounted horizontally across the air duct on opposite sides of and parallel to the heat exchanger adjacent the upper end of the sides of the heat exchanger. The pair of tubes each have a plurality of longitudinal slots therein for fan-shaped spraying of cleaning liquid from each of the slotted holes toward the heat exchanger. Although less desirable because it does not clean as completely, it is possible to utilize a single tube located on only one side of the heat exchanger.

Each of the pair of tubes has extending from it to a location outside of the air duct a connection means to allow detachable connection of a hose or the like. A pressurized cleaning liquid supply means is provided for detachable connection to this connection means allowing cleaning liquid to be sprayed through the tubes as desired in order to clean the heat exchanger. Preferably this connection is a quick-connect coupling to allow speedy operation of the cleaning system.

The source of pressurized cleaning liquid preferably includes one tank containing a cleaning liquid, a second tank containing a rinsing liquid and a pump for pressurizing and moving the liquid from either of the tanks. The tanks and pump can be mounted on a base or cart having wheels to allow rolling transportation of the cleaning liquid supply.

The method of the present invention comprises detachably connecting the source of pressurized cleaning liquid and rinsing liquid to a selected one of the tubes mounted in the air duct. The source of pressurized cleaning liquid and rinsing liquid is then selectively actuated to spray cleaning liquid from the tube onto the heat exchanger. After the spraying of the cleaning liquid, the source of pressurized cleaning liquid and rinsing liquid is selectively actuated to spray rinsing liquid from the tube onto the heat exchanger. After the spraying of rinsing liquid, the source of cleaning liquid and rinsing liquid is detached from the tube.

When a pair of tubes is provided for the heat exchanger, it is preferable to spray cleaning liquid through both tubes prior to spraying rinsing liquid through the tubes. This provides a better coverage of the cleaning liquid on the fins prior to the cleaning liquid being rinsed away.

An important feature of the tubes of the present invention is that the plurality of slots in the tubes have a radial, disc-section configuration so as to produce a fan-shaped spray as the liquid passes therethrough. Further, the slots are disposed in two rows with adjacent slots slightly overlapping. This produces a spray which better penetrates the fins while still providing a more uniform coating along the interior of the fins.

For a further understanding of the present invention and further objects, features and advantages thereof, reference may now be had to the following description taken in conjunction with the accompanying drawings.

DESCRIPTION OF PREFERRED EMBODIMENTS

Figure 1:
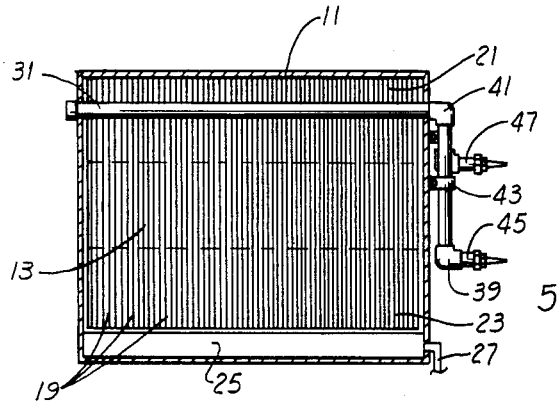
FIG. 1 is a side view of a heat exchanger mounted in an air duct incorporating the tube of the present invention.
Figure 3:
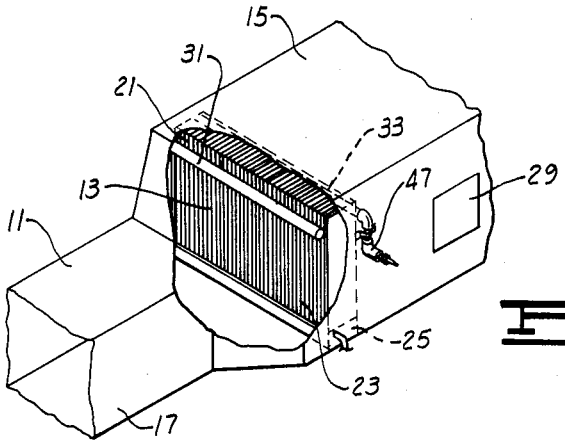
FIG. 3 is a cut-away perspective view of the device shown in FIG. 1.

Referring to FIGS. 1 and 3, a conventional air duct 11 having a heat exchanger 13 mounted transversely therein is shown. The heat exchanger 13 is located in an enlarged portion 15 of the air duct 11. A smaller portion 17 of the air duct 11 is provided downstream of the heat exchanger 13 to provide a faster flow of air after air passes through the heat exchanger 13. A squirrel cage fan or the like (not shown) is provided upstream of the heat exchanger 13 in the enlarged portion 15 of the air duct 11. This fan moves the air through the air duct 11 and the heat exchanger 13.

The heat exchanger 13 includes a set of fins 19, each of which is connected to horizontally extending coil tubes located in the interior of the heat exchanger 13. The fins 19 are oriented so that the horizontal axis of the fins extends parallel to the horizontal axis of the air duct 11. This allows the air to move between the fins and to exchange heat as it moves through the air duct 11. Each of the fins has a front and back edge. These edges together form the side walls of the heat exchanger 13. These side walls have an upper end 21 and a lower end 23.

As a heat exchange fluid is circulated through the coiled tubes of the heat exchanger 13 and air is circulated between the fins 19 of the heat exchanger 13, often condensation forms on the fins 19 and drips to the bottom of the heat exchanger 13. A pan 25 within the air duct 11 catches the condensation and allows it to drain through a drain pipe 27 out of the duct 11.

As shown in FIG. 3, an access panel 29 is provided in the enlarged portion 15 of the air duct 11 upstream of the heat exchanger 23. Such access panels are often provided to allow access to the upstream side of the heat exchanger 23 and to the squirrel cage fan.

In large buildings, often many heat exchangers, such as heat exchanger 13, are disposed in air ducts throughout the building. The present invention provides a much improved method and device for providing cleaning of all of the heat exchangers in such a building.

The present invention includes a pair of plastic tubes 31 and 33 mounted on the downstream and upstream sides, respectively, of the heat exchanger 13. Each of the plastic tubes is mounted horizontally across the air duct 11 and adjacent the upper end 21 of the sides of the heat exchanger 13. Preferably, the tubes 31 and 33 run parallel to the edges of the fins 19, clearing the fins 19 only between $\frac{1}{8}$ and $\frac{1}{2}$ inch (most preferably, $\frac{1}{4}$ inch). The vertical position of the tubes 31 and 33 is such that the tubes 31 and 33 are located just below the uppermost coil tube within the heat exchanger 13. Preferably the tubes 31 and 33 are made of $\frac{1}{2}$ inch PVC pipe.

Figure 2:
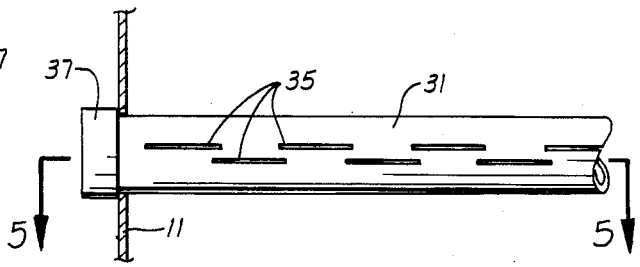
FIG. 2 is a side view of a portion of the tube shown in FIG. 1 from the side opposite shown in FIG. 1.
Figure 5:
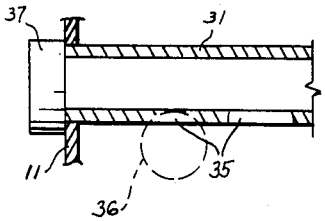
FIG. 5 is a partial cross section taken along lines 5—5 of FIG. 2 and showing details of the slots in the tubes.

As shown in FIG. 2 and FIG. 5, the tube 31 and the tube 33 each have a plurality of slots 35 extending longitudinally along the tube in two closely spaced rows. Each of the slots 35 is formed by a thin disc-shaped saw 36. Preferably, the saw blade is approximately 5/1000's inch thick and approximately $\frac{3}{4}$ inch in diameter. The slots cut by the saw blade are approximately $\frac{1}{2}$ inch long and, thus, have a radial, disc-section configuration best seen in FIG. 5 so as to produce a fan-shaped spray as liquid from the tube 31 sprays through the slots 35. The fan shape is important to allow even distribution of the liquid sprayed from the tube through the heat exchanger 13 along the walls of the fin 19.

The slots 35 are disposed in two rows such that adjacent slots slightly overlap. This also contributes to the even distribution of the liquid sprayed into the heat exchanger 13 onto the fins 19 and the coil tubes of the heat exchanger.

The tubes 31 and 33 extend all the way through the air duct 11 and are capped by a cap 37 outside of one side of the air duct 11. A pair of elbows 39 and 41 extend the tube 31 outside the opposite side of the air duct 11 adjacent the wall of the air duct 11 and then at a right angle to the air duct 11. A clamp 43 fixes the elbows 39 and 41 and the pipe 31 against movement with respect to the air duct 11 or the heat exchanger 13. The plastic tube 33 is also mounted to the air duct 11 with elbows, clamps and caps in the same manner as is the plastic tube 31.

At the outwardly extending portion of the elbow 39 is a quick-connect coupling 45. The outwardly extending elbow of tube 33 also has such a quick-connect coupling 47. Such quick-connect couplings allow a snap connection and disconnection of a hose or the like.

The tubes are installed simply by drilling holes in the duct walls at the appropriate location in inserting the tubes through the holes. The caps and clamps are then attached to fix the tubes. The duct at the location where the tubes penetrate can be sealed if desired. Thus, it is not necessary to cut access ports to install the invention.

Figure 4:
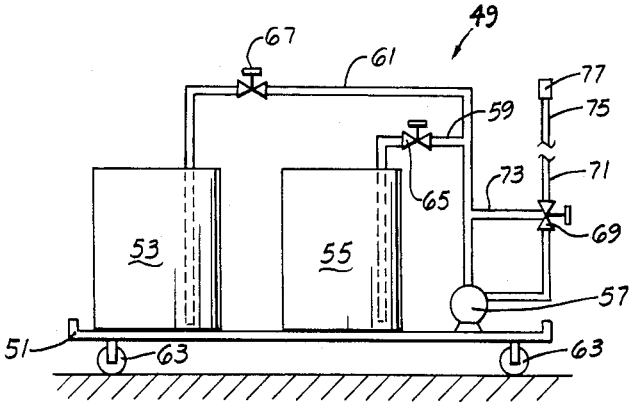
FIG. 4 is a schematic view of the cleaning liquid supply portion of the present invention.

In order to supply cleaning liquid and rinsing liquid to the tubes 31 and 33, a pressurized source of such liquid is required. Referring to FIG. 4, an especially desirable such device 49 is shown. The device 49 includes a cart 51 upon which tanks 53 and 55 are mounted. A pump 57 is also mounted on cart 51 and is connected by conduits 59 and 61 to each of tanks 53 and 55. The cart 51 has ground-engaging wheels 63 to allow rolling transportation of the device 49.

The conduits 59 and 61 have valves 65 and 67, respectively, to allow selective pumping of liquid from either of tank 53 or 55 through pump 57. A pressure regulating valve 69 is provided on the outlet conduit 71 from pump 57. Also, a pressure relief conduit 73 extends from the pressure regulator valve 69 to the inlet of pump 57 to relieve pressure in the event that the outlet conduit 71 is clogged. Attached to outlet conduit 71 is a hose 75 and the end of hose 75 is provided with a quick-connect coupling 77 which will mate with the couplings 45 or 47.

Preferably, the pump 57 is a piston-type pump and tanks 53 and 55 are 15-gallon PVC barrels. The pump 57 should provide a maximum 200 pounds pressure and 2 gallons per minute of flow. The tanks are plastic so that either a caustic degreaser or an acid-base coil cleaner can be contained therein.

In use, tank 53 is filled with a cleaner such as an acid-base coil cleaner or a caustic degreaser and the tank 55 is filled with a rinsing liquid such as water. After filling, the cart 51 is rolled to a position adjacent the air duct 11 so that the hose 75 can be connected to one of the tubes 31 or 33 by means of the quick-connect coupling. Valve 67 is opened and valve 65 is closed to allow only cleaner to pass through the selected tube and sprayed onto the heat exchanger 13. The pump 57 is actuated and the cleaning liquid sprays onto the heat exchanger 23 for a predetermined amount of time based upon the size of the heat exchanger and how dirty the heat exchanger is. After spraying one side of the heat exchanger with cleaning fluid, the hose is then detached and connected to the other tube. Cleaning fluid is then sprayed on the opposing side of the heat exchanger 13.

Following spraying of the heat exchanger 13 with cleaning fluid on both sides, the pump 57 is deactivated and valve 67 closed while valve 65 is opened. Rinsing liquid from tank 55 is then sprayed through tubes 31 and 33, alternately, in the same manner as cleaning liquid is sprayed through the tubes.

As the cleaning liquid and the rinsing liquid are sprayed on the heat exchanger 13, the liquid trickles down the heat exchanger fins cleaning the entire heat exchanger and not just the upper ends. The liquid falls into the drain pan 25 and leaves the air duct 11 by means of the drain 27.

Preferably, the tubes 31 and 33 are oriented to aim the slots 35 for approximately horizontal spraying toward the upper end of the heat exchanger 13. This allows the sprayed liquids to properly penetrate the heat exchanger and to trickle down for cleaning the entire heat exchanger. The sprayed liquid does not spray entirely through the heat exchanger because of the contact with the fins.

Thus, the method and device of the present invention are well adapted to attain the objects and advantages mentioned as well as those inherent therein. While presently preferred embodiments of the invention have been described for the purpose of this disclosure, numerous changes in the construction and arrangement of parts and the steps in the method can be made by those skilled in the art, which changes are encompassed within the spirit of this invention as defined by the appended claims.

The foregoing disclosure and the showings made in the drawings are merely illustrative of the principles of this invention and are not to be interpreted in a limiting sense.

What is claimed is:

1. An improved method of cleaning a fin-type heat exchanger mounted transversely in an air duct of an air conditioning or heating system, the heat exchanger having vertically extending fins forming opposing side walls with upper and lower ends, the method comprising the steps of:

detachably connecting a source of pressurized cleaning liquid and rinsing liquid to a tube fixedly mounted across the air duct adjacent the upper end of a selected one of the side walls of the heat exchanger, said tube having parallel rows of slot-shaped holes therein with overlapping adjacent holes and aimed for spraying of liquid toward the upper end of the selected one of the side walls of the heat exchanger;

selectively actuating said source of pressurized cleaning liquid and rinsing liquid to spray cleaning liquid from said tube through said slots in a fan shaped pattern onto said heat exchanger;

after said spraying of cleaning liquid, selectively actuating said source of pressurized cleaning liquid and rinsing liquid to spray rinsing liquid from said tube through said slots in a fan-shaped pattern onto said heat exchanger; and after said spraying of rinsing liquid, detaching said hose from said fixedly mounted tube.

2. In an air conditioner or heating system of the type having air duct with side walls and having a parallel fin-type heat exchanger transversely mounted in the air duct for heat exchange with air conveyed in the air duct, the heat exchanger having vertically extending fins forming opposing side walls of the heat exchanger with upper and lower ends, the improvement comprising:

a tube mounted horizontally across the air duct between the side walls of the air duct and adjacent the upper end of a selected one of the side walls of the heat exchanger, said tube having means defining two rows of slot-shaped holes therein with adjacent holes overlapping aimed for uniform spraying of cleaning liquid toward the upper end of said selected one of the side walls of the heat exchanger, each of said slot-shaped holes having a radial, disk-section configuration to produce a fan-shaped spray of cleaning liquid;

a connector conduit extending outside of the air duct from said tube;

a quick connect coupling attached to said connector conduit for detachably receiving a hose connection thereto; and pressurized cleaning liquid supply means for supplying pressurized cleaning liquid and including a hose for detachable connection to said quick-connect coupling.

3. A cleaning system for an air conditioner or heater of the type having an air duct for conveying air with a parallel fin-type heat exchanger transversely mounted in said air duct for heat exchange with air conveyed in the duct, said heat exchanger having vertically extending fins the edges of which form opposing sides of the heat exchanger, the cleaning system comprising:

a pair of tubes mounted horizontally across the air duct on opposite sides of and parallel to the heat exchanger adjacent the upper end of the sides of the heat exchanger;

said pair of tubes each having means defining two rows of longitudinal slot-shaped holes therein with adjacent slot-shaped holes overlapping and each slot-shaped hole having a radial disk-section configuration for fan shaped spraying of cleaning liquid from each of said slot-shaped holes toward said heat exchanger;

pressurized cleaning liquid supply means for supplying pressurized cleaning liquid; and each of said pair of tubes having connection means disposed on the exterior of said air duct for detachably connecting said pair of tubes to said pressurized cleaning liquid supply means.

4. The cleaning system of claim 3 wherein said connection means comprises a quick-connect coupling.

5. The cleaning system of claim 3 wherein said pressurized cleaning liquid supply means comprises:

a first tank for containing a cleaning liquid;

a second tank for containing a rinsing liquid;

a pump for pressurizing and moving liquid; and conduit and valve means for connecting said pump to a selected one of said first tank and said second tank.

6. The cleaning system of claim 5 wherein said pressurized cleaning liquid supply means further comprises:

a base upon which said first tank and said second tank and said pump are mounted;

said base having ground-engaging wheels allowing rolling transportation of said pressurized cleaning liquid supply means.

7. The cleaning system of claim 3 wherein said plurality of slots of said tubes are aimed for approximately horizontal fan-shaped spray toward said heat exchanger.

8. The cleaning system of claim 7 wherein said pair of tubes are formed of plastic.

* * * * *